US006319061B1

(12) United States Patent
Chen et al.

(10) Patent No.: US 6,319,061 B1
(45) Date of Patent: Nov. 20, 2001

(54) PAIR OF SHIELDED ELECTRICAL CONNECTORS WITH A GROUNDING ELEMENT THEREBETWEEN

(75) Inventors: Qiang Chen; Guang Xing Shi, both of Kunsan (CN)

(73) Assignee: Hon Hai Precision Ind. Co., Ltd ., Taipei Hsien (TW)

( * ) Notice: Subject to any disclaimer, the term of this patent is extended or adjusted under 35 U.S.C. 154(b) by 0 days.

(21) Appl. No.: 09/745,307

(22) Filed: Dec. 22, 2000

(30) Foreign Application Priority Data

Nov. 23, 2000 (TW) ..... 89220359 U

(51) Int. Cl.[7] ..... H01R 13/648
(52) U.S. Cl. ..... 439/607; 439/609
(58) Field of Search ..... 439/609, 607, 439/608, 610

(56) References Cited

U.S. PATENT DOCUMENTS 6,132,254 * 10/2000 Wu ..... 439/607
6,139,367 * 10/2000 Yeh ..... 439/609
6,190,205 * 2/2001 Wu ..... 439/607
6,193,554 * 2/2001 Wu ..... 439/607

* cited by examiner

*Primary Examiner*—Tulsidas Patel
*Assistant Examiner*—Chandrika Prasad
(74) *Attorney, Agent, or Firm*—Wei Te Chung

(57) ABSTRACT

An electrical connector (1) includes a plurality of electrical connector modules (2) and a conductive grounding element (3). The electrical connector modules each includes an insulative housing (11), a number of electrical terminals (12) received in the insulative housing, a front shield (13), and a rear shield (14) retained to the front shield and the insulative housing. The grounding element includes a retention section (30) retained by the front and rear shields and an engaging section (31) extending between and forwardly beyond the electrical connector modules.

12 Claims, 4 Drawing Sheets

PAIR OF SHIELDED ELECTRICAL CONNECTORS WITH A GROUNDING ELEMENT THEREBETWEEN

BACKGROUND OF THE INVENTION

1. Field of the Invention

The present invention relates to an electrical connector, and particularly to a shielded electrical connector with a grounding element.

2. Description of the Related Art

Shielded electrical connectors are used more and more widely with the increasing development of information technology. Many electrical connectors have grounding elements for electrically connecting a grounded shield thereof to a shielding device enclosure panel or to a mating complementary connector for increasing the quality of signal transmission. Conventional grounding elements of electrical connectors are usually attached to the electrical connector using screws and nuts, which increases the number of parts used in assembling the electrical connector and which increases the volume of the electrical connector. Other electrical connectors have grounding elements which are retained by an insulative housing of the electrical connector, resulting in a complicated design for the insulative housing and increasing the volume of the insulative housing, in turn increasing the volume of the electrical connector. Increasing of the volume of an electrical connector runs counter to the trend toward lighter, thinner, shorter and smaller electrical connectors.

Therefore, an electrical connector with an improved grounding element is required to overcome the disadvantages of the prior art.

SUMMARY OF THE INVENTION

A major object of the present invention is to provide an electrical connector having a grounding element which is reliably retained to the electrical connector without increasing the volume of the electrical connector while still effectively providing a grounding function.

A shielded electrical connector in accordance with the present invention comprises a plurality of electrical connector modules and a conductive grounding element. Each of the electrical connector modules comprises an insulative housing, a plurality of electrical terminals received in the insulative housing, a conductive front shield and a conductive rear shield. The grounding element comprises a retention section and an engaging section. The retention section of the grounding element is reliably retained and electrically connected to the front and rear shields of the electrical connector modules. The engaging section of the grounding element is substantially V-shaped and extends between and forwardly beyond the electrical connector modules.

Other objects, advantages and novel features of the invention will become more apparent from the following detailed description of the present embodiment when taken in conjunction with the accompanying drawings.

DETAILED DESCRIPTION OF THE INVENTION

Figure 1:
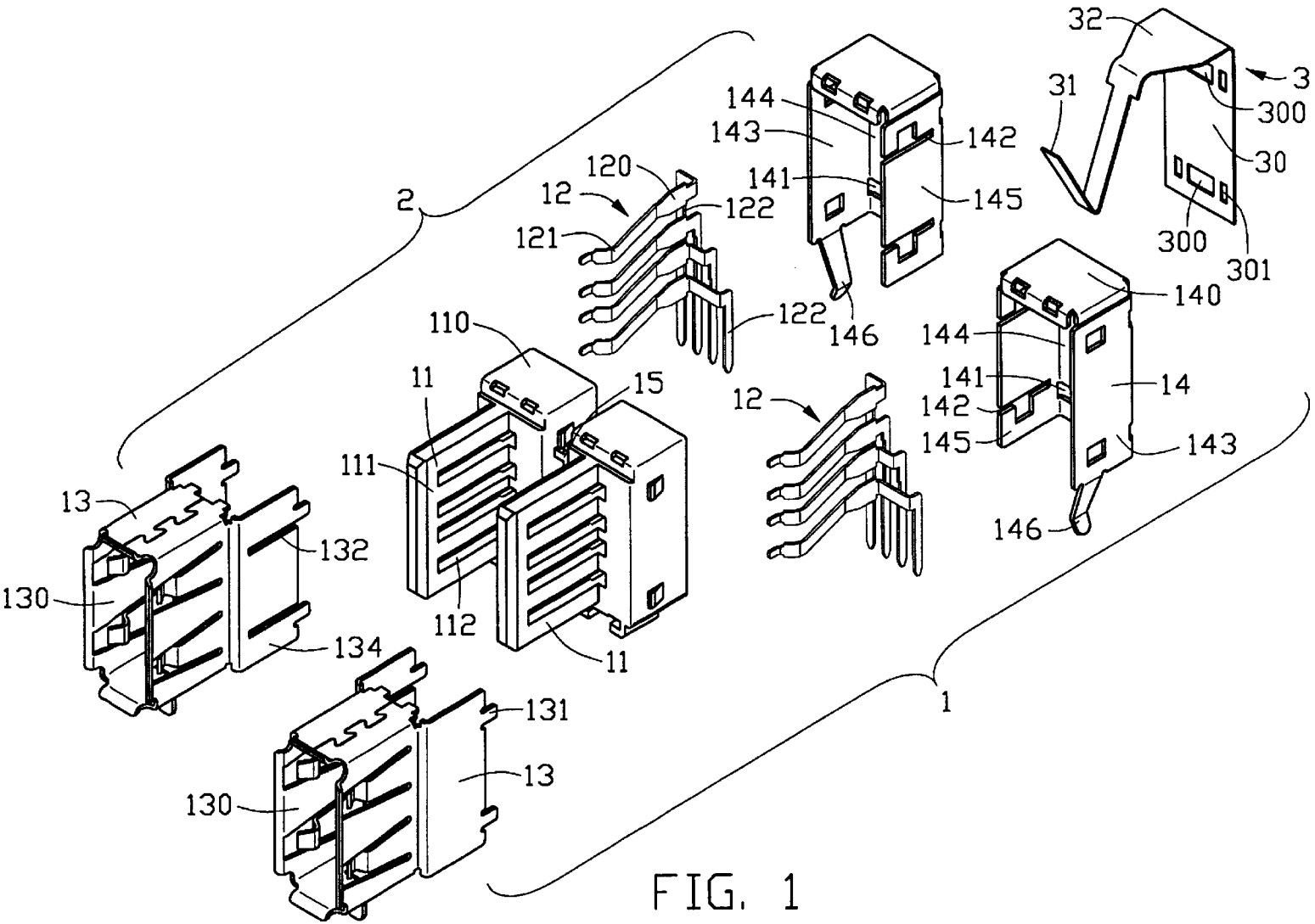
FIG. 1 is an exploded view of a side-by-side electrical connector in accordance with the present invention.

Referring to FIG. 1, an electrical connector 1 in accordance with the present invention comprises a pair of side-by-side located electrical connector modules 2 and a conductive grounding element 3.

Each of the electrical connector modules 2 comprises an insulative housing 11, a plurality of electrical terminals 12, a conductive front shield 13, and a conductive rear shield 14.

Each insulative housing 11 comprises a base portion 110 and an island portion 111 protruding forwardly from a front surface (not labeled) of the base portion 110. A plurality of terminal passageways 112 are formed in a vertical surface (not labeled) of the island portion 111 and extend from the front surface to a rear surface (not shown) of the base portion 110. A pair of spaced ribs(spacers) 15 are formed between a pair of base portions 110 of the insulative housings 11 to connect two insulative housings 11 side by side for use in the side-by-side electrical connector 1.

Each of the electrical terminals 12 comprises a fixing section 120, a contacting section 121 extending forwardly from the fixing section 120 and a mounting section 122 extending outwardly and downwardly from the fixing section 120. The mounting sections 122 of the electrical terminals 12 vary in lengths and shapes.

A pair of mirror-image, complementary front shields 13 are used in the side-by-side electrical connector 1. Each front shield 13 comprises a generally rectangular forward section 130 and a pair of extensions 134 extending rearwardly from two opposite side walls of the forward section 130. A pair of opposing extensions 134 of each pair of complementary front shields 13 each defines a pair of slits 132 extending forwardly from a rear edge thereof. The slits 132 are configured and spaced from each other corresponding to the ribs 15 connecting the pair of insulative housings 11. The extensions 134 each defines a pair of spaced tabs 131 extending rearwardly therefrom.

A pair of mirror-image, complementary rear shields 14 are used in the side-by-side electrical connector 1. Each rear shield 14 comprises a top wall 140, a first side wall 143, a second side wall 145 and a rear wall 144 and is open in a front and bottom thereof. Each first side wall 143 forms a grounding tab 146 depending downwardly from a bottom edge thereof. Each second side wall 145 defines a pair of spaced slots 142 extend rearwardly from a forward edge thereof. Each rear wall 144 defines two pairs of openings 141 in an upper section and a lower section thereof adjacent to the first and second side walls 143, 145, respectively.

The grounding element 3 comprises a retention section 30, an engaging section 31 and a transition section 32 between the retention and engaging sections 30, 31. The retention section 30 is a generally rectangular piece and defines a pair of rectangular holes 300 in an upper and a lower sections thereof and a pair of through holes 301 at two opposite sides of each hole 300. The transition section 32 extends perpendicularly and forwardly from an upper edge of the retention section 30. The engaging section 31 firstly extends downwardly and forwardly at an angle from a forward edge of the transition section 32 and then extends upwardly and forwardly at an angle to define a generally V-shaped configuration.

Figure 2:
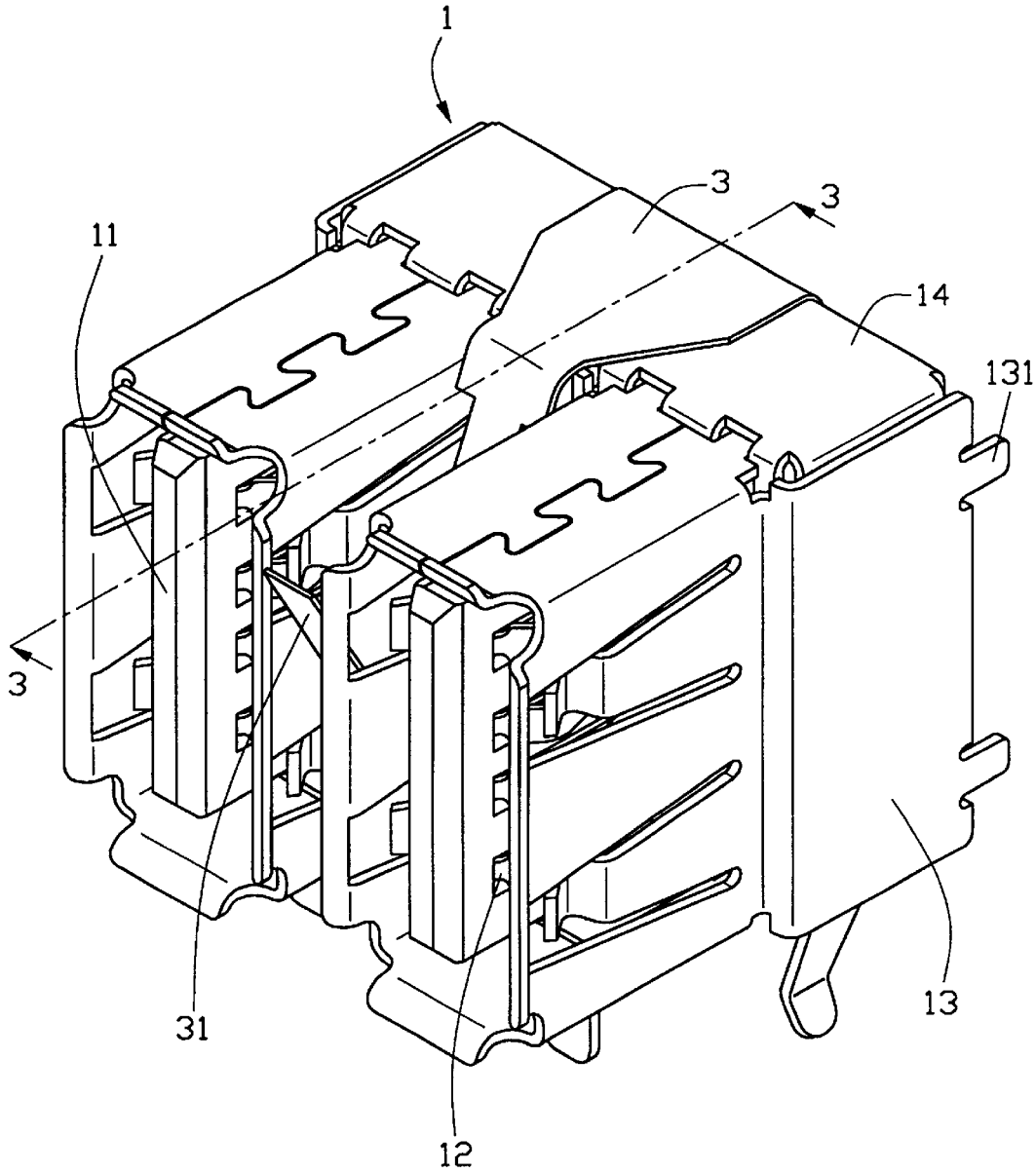
FIG. 2 is an assembled perspective view of the side-by-side electrical connector of FIG. 1.
Figure 3:
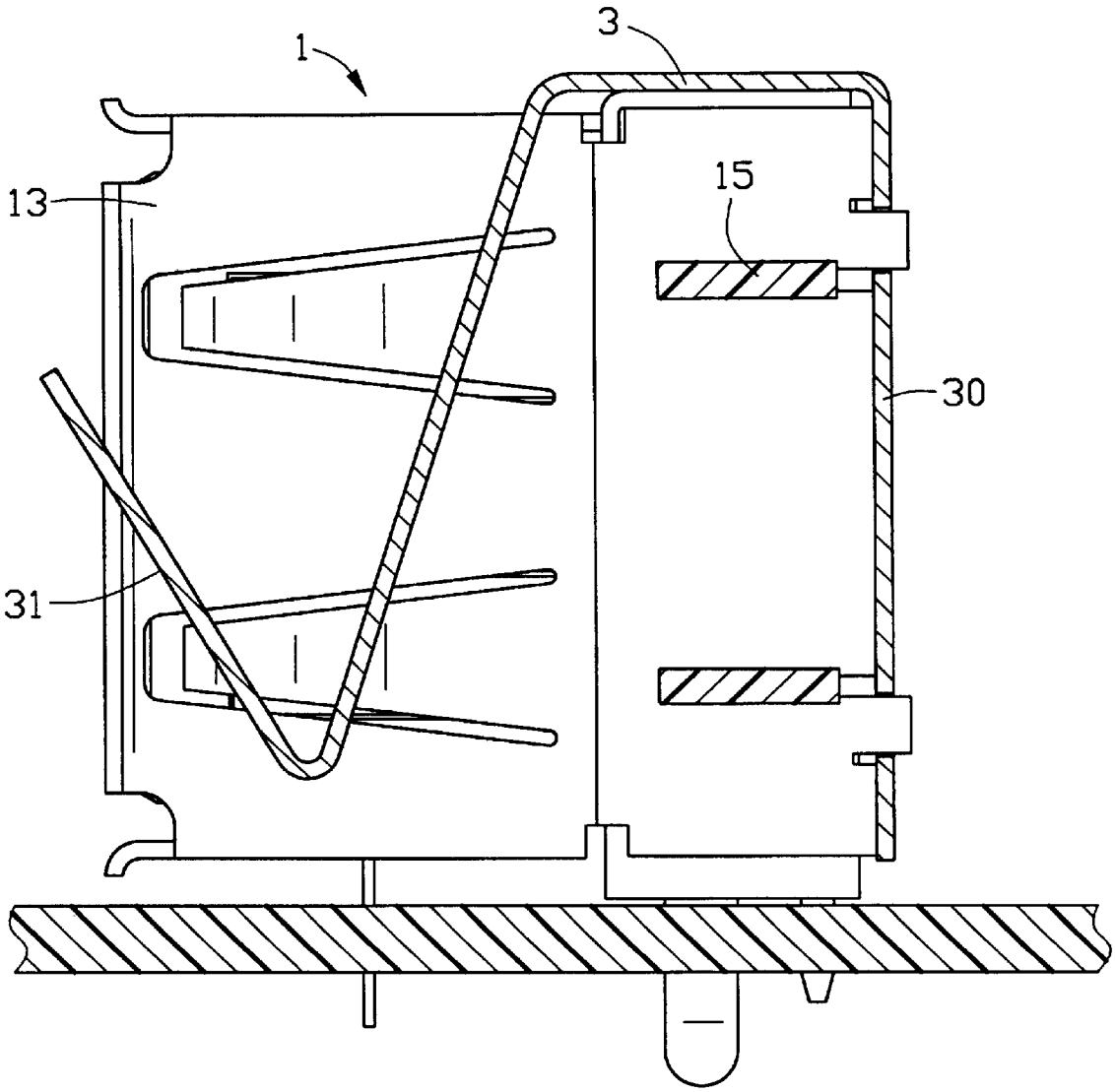
FIG. 3 is a cross-sectional view taken along line 3—3 of FIG. 2.
Figure 4:
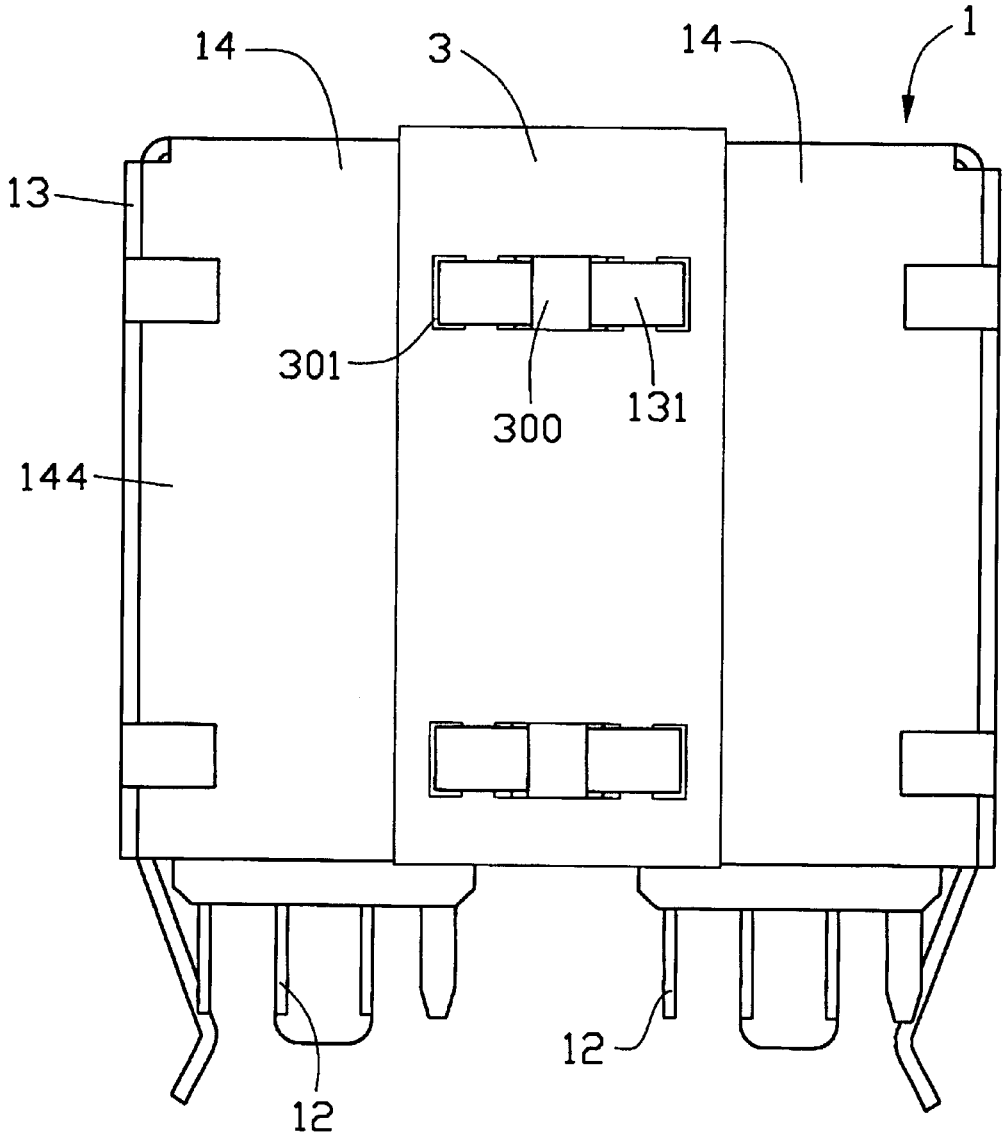
FIG. 4 is a rear planar view of FIG. 2.

Referring also to FIGS. 2–4, in assembly, the electrical terminals 12 are assembled in the insulative housings 11. The contacting sections 121 and the fixing sections 120 of the electrical terminals 12 are received in a vertical row in the terminal passageways 112 of each insulative housing 11 with the terminals 12 having longer retention sections 122 being positioned in the higher terminal passageways 112.

The rear shields 14 are assembled to substantially enclose the base portions 110 of the insulative housings 11 with the slots 142 of the second side walls 145 receiving the ribs 15 therein. The front shields 13 are assembled to the insulative housings 11 with the slits 132 thereof also receiving the ribs 15 therein. The extensions 134 of the front shields 13 overlap the first and second side walls 143, 145 of the rear shields 14. The retention section 30 of the grounding element 3 is attached to the rear walls 144 of the rear shields 14 with each hole 300 receiving two tabs 131 of opposing extensions 134 of the front shields 13 having the slits 132 therein. The engaging section 31 extends between the front shields 13 and substantially beyond a forward edge of the front shields 13. The tabs 131 received in the holes 300 are bent toward outward sides of the side-by-side electrical connector 1 and are further extended through the through holes 301 of the grounding element 3 and through the openings 141 of the rear shields 14 adjacent to the second side walls 145. The tabs 131 of the extensions 134 without slits 132 are bent to extend into the openings 141 of the rear shields 14 adjacent to the first side walls 143.

The grounding element 3 is reliably retained by the front and rear shields 13, 14 of the side-by-side electrical connector 1 without additional elements and without complicating the design of the insulative housings 11. Therefore, the side-by-side electrical connector 1 is compact. The engaging section 31 of the grounding element 3 has a generally V-shaped configuration which provides greater flexibility than prior art designs, and therefore a more reliable grounding connection to a complementary connector or a conductive panel is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a conductive grounding element; and a plurality of electrical connector modules, the electrical connector modules each comprising:

an insulative housing;

a plurality of electrical terminals received in the insulative housing; and a conductive shield enclosing the insulative housing;

wherein the insulative housings of adjacent electrical connector modules are connected to each other, the conductive grounding element is retained by the shields of the plurality of electrical connector modules and comprises an engaging section extending between and forwardly beyond the shields.

2. The electrical connector as claimed in claim 1, wherein the shields each comprises a rear shield and a front shield assembled to the rear shield, the front and rear shields each defining a pair of slits and slots, respectively.

3. The electrical connector as claimed in claim 2, wherein adjacent insulative housings form a pair of ribs therebetween, which are received by the slits and slots of the front and rear shields.

4. The electrical connector as claimed in claim 2, wherein the front shields each comprise a forward section and a pair of extensions extending rearward from the forward section, the extensions defining a plurality of slits receiving the ribs between the insulative housings.

5. The electrical connector as claimed in claim 4, wherein the extensions of the front shields form a plurality of tabs thereon and the grounding element comprises a retention section defining a plurality of holes receiving at least some of the tabs of the front shields.

6. The electrical connector as claimed in claim 5, wherein the retention section of the grounding element further defines a pair of through holes beside two opposite sides of each hole, and the rear shields define a plurality of openings, the tabs of the extensions which extend through the holes then extending into the through holes of the retention section of the grounding element and then into the openings of the rear shields.

7. The electrical connector as claimed in claim 1, wherein the electrical terminals are assembled in each insulative housing in a vertical row.

8. The electrical connector as claimed in claim 1, wherein the engaging section of the grounding element extends firstly downwardly and forwardly and then upwardly and forwardly to be in a generally V-shaped configuration.

9. The electrical connector as claimed in claim 1, wherein the insulative housings are arranged side by side.

10. An electrical connector assembly comprising:

first and second connectors side by side little spaced from each other with spacers therebetween;

each of said first and second connectors including an insulative housing enclosed by front and rear shields;

said front shield defining at least a tab on an inner side of a rear portion thereof;

said rear shield defining at least an opening in an inner side of a rear portion thereof; and a retention member including a rectangular retention section extending substantially a full height of said rear shield and defining holes therein; wherein each tab of each connector extends through the corresponding hole and the corresponding opening to fasten said front shield, said rear shield and said retention member together.

11. The assembly as claimed in claim 10, wherein a grounding engagement section integrally extends forwardly from said retention member between said first and second connectors for engagement with a panel in front of said connector assembly.

12. An electrical connector assembly comprising:

first and second connectors side by side little spaced from each other with spacers therebetween;

each of said first and second connectors including an insulative housing enclosed by shield means;

a grounding element including a retention section and an engagement section;

the retention section fastened to rear portions of said shield means of said first and second connectors, and the engagement section being integrally formed with said retention section and forwardly extending between said first and said second connectors for engagement with a panel located in front of said assembly; wherein via cooperation of said spacers and said retention section, the first connector and the second connector can be firmly assembled together with the engagement section extending therebetween.

* * * * *